US006058280A

United States Patent [19]

Kumar et al.

[11] Patent Number: 6,058,280

[45] Date of Patent: May 2, 2000

[54] MOLDED QUICK CHANGE PHOTORECEPTOR SUPPORT

[75] Inventors: Ajay Kumar, Fairport; Dhirendra C. Damji, Webster, both of N.Y.

[73] Assignee: Xerox Corporation, Stamford, Conn.

[21] Appl. No.: 08/970,313

[22] Filed: Nov. 14, 1997

[51] Int. Cl.[7] ..... G03G 15/00

[52] U.S. Cl. ..... 399/117

[58] Field of Search ..... 347/138; 399/111, 399/113, 117, 167

[56] References Cited

U.S. PATENT DOCUMENTS

| | | | |
|---|---|---|---|
| 5,170,212 | 12/1992 | DeCecca | 355/245 |
| 5,294,960 | 3/1994 | Nomura et al. | 399/113 |
| 5,444,516 | 8/1995 | Michlin et al. | 355/200 |
| 5,446,525 | 8/1995 | Kobayashi | 399/111 |
| 5,452,056 | 9/1995 | Nomura et al. | 355/200 |
| 5,457,520 | 10/1995 | Schell et al. | 355/213 |
| 5,543,891 | 8/1996 | Setoriyama | 399/111 |

*Primary Examiner*—Joan Pendegrass
*Attorney, Agent, or Firm*—Andrew D. Ryan

[57] ABSTRACT

A supporting apparatus for supporting a photoconductive member within the housing of a printing cartridge for use in a printing machine is provided. The supporting apparatus includes a body, a connecting feature and a supporting feature. The connecting feature is connected to the body for quick and removable connection to the housing. The supporting feature is connected to the body cooperating with the body for rotatably supporting the photoconductive member within the housing.

30 Claims, 10 Drawing Sheets

MOLDED QUICK CHANGE PHOTORECEPTOR SUPPORT

RELATED CASES

Cross reference is made to the following applications filed concurrently herewith: U.S. Ser. No. 08/971,073 entitled "Pin Charge Corotron With Optimum Dimensions For Minimum Ozone Production" by Dhirendra C. Damji et al., U.S. Ser. No. 08/970,719 entitled "Development Bias Connector With Integral Bearing Support" by Dhirendra C. Damji et al., U.S. Ser. No. 08/970,842 entitled "Charging Device Module For Use With Print Cartridge" by Ajay Kumar et al., U.S. Ser. No. 08/971,098 entitled "Charging Device Having An Electrode With Integral Electrical Connector" by Ajay Kumar et al., U.S. Ser. No. 08/971,015 entitled "Charging Device Having A Shield With Integral Electrical Connector" by Ajay Kumar et al., U.S. Ser. No. 08/970,322 entitled "Process Cartridge Including Process Components Having Critical Image Quality And Life-Extending Process Path Acting Regions" by Dhirendra C. Damji et al., U.S. Ser. No. 08/971,690 entitled "Variable Size, Replaceable Toner Sump Pans For Print Cartridges" by Dhirendra C. Damji et al., U.S. Ser. No. 08/971,010 entitled "Printing Cartridge With Planar Drive Train" by Ajay Kumar et al., U.S. Ser. No. 08/970,839 entitled "Process Cartridge Including A Handle Defining Part Of A Machine Paper Path" by Dhirendra C. Damji et al., U.S. Ser. No. 08/970,321 entitled "Electrostatographic Process Cartridge Having A Non-Metallic Photoreceptor Grounding Pin" by Daniel A. Chiesa et al., U.S. Ser. No. 08/970,318 entitled "Limited Life Electrostatographic Process Cartridge Having A Waste Toner Electro-Sump Subassembly" by Daniel A. Chiesa et al., U.S. Ser. No. 08/970,324 entitled "Process Cartridge Having A Drive Assembly Resultant Force Counter-Acting Member" by Dhirendra C. Damji et al., U.S. Ser. No. 08/990,320 entitled "Process Cartridge Including A Banding Defect Preventing Waste Toner Moving Auger" by Dhirendra C. Damji et al., U.S. Ser. No. 08/970,323 entitled "Process Cartridge Including A Developer Housing Defining Part Of A Machine Paper Path" by Dhirendra C. Damji et al., U.S. Ser. No. 08/970,847 entitled "All -In-One Process Cartridge Including A Photoreceptor And Process Components Having Relative Critical, Image Quality Acting Regions" by Dhirendra C. Damji et al., U.S. Ser. No. 08/971,691 entitled "Printing Cartridge With Molded Cantilever Developer Roller Spacing Spring" by Ajay Kumar et al., and U.S. Ser. No. 08/970,319 entitled "User Interface For An Electrostatographic Reproduction Machine" by Mark L. Leveto.

BACKGROUND

This invention relates to electrostatographic reproduction machines, and more particularly to an economical and capacity-extendible all-in-one process cartridge for easy adaptive use in a family of compact electrostatographic reproduction machines having different volume capacities and consumable life cycles. Specifically this invention relates to such a cartridge including a molded quick change photoreceptor support.

Generally, the process of electrostatographic reproduction, as practiced in electrostatographic reproduction machines, includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred at a transfer station onto a copy sheet fed to such transfer station, and on which the toner particles image is then heated and permanently fused so as to form a "hardcopy" of the original image.

It is well known to provide a number of the elements and components, of an electrostatographic reproduction machine, in the form of a customer or user replaceable unit (CRU). Typically such units are each formed as a cartridge that can be inserted or removed from the machine frame by a customer or user. Reproduction machines such as copiers and printers ordinarily include consumable materials such as toner, volume limiting components such as a waste toner container, and life cycle limiting components such as a photoreceptor and a cleaning device. Because these elements of the copying machine or printer must be replaced frequently, they are more likely to be incorporated into a replaceable cartridge as above.

There are therefore various types and sizes of cartridges, varying from single machine element cartridges such as a toner cartridge, to all-in-one electrostatographic toner image forming and transfer process cartridges. The design, particularly of an all-in-one cartridge can be very costly and complicated by a need to optimize the life cycles of different elements, as well as to integrate all the included elements, while not undermining the image quality. This is particularly true for all-in-one process cartridges to be used in a family of compact electrostatographic reproduction machines having different volume capacities and elements having different life cycles.

There is therefore a need for a quality image producing, economical and capacity-extendible all-in-one process cartridge that is easily adapted for use in various machines in a family of compact electrostatographic reproduction machines having different volume capacities and elements with different life cycles.

Photoconductive drums are required to rotate relative to the mating housing. The accuracy of the mounting of the photoconductive drum to the housing is important for image quality. Further, insulation techniques may be time consuming and expensive.

Further, when utilizing printing machines having modules, for example the CRU module, separate development modules, and other portions of the machine which provide for scanning, the cooperation and assembly of the respective components may provide for a stack or error which may be harmful to the image quality of the copying machine. This is particularly true for the alignment of the photoconductive drum to the ROS or imaging scanner of the printing machine. The accuracy of which the laser image is placed upon the photoconductive drum drastically effects the accuracy and image quality of the resulting document.

The mounting and assembly of the photoconductive drum on to the housing may require expensive and complicated parts which may be assembled with expensive and complicated equipment and tools. Further, during re-manufacturing the components need to be disassembled for the inspection of the photoconductive drum. Mounting techniques may make this procedure expensive and very difficult.

The following disclosures may be relevant to various aspects of the present invention:

U.S. Pat. No. 5,170,212

Patentee: DeCecca, et al.

Issue Date: Dec. 8, 1992

U.S. Pat. No. 5,452,056

Patentee: Nomura, et al.

Issue Date: Sep. 19, 1995

U.S. Pat. No. 5,457,520

Patentee: Schell, et al.

Issue Date: Oct. 10, 1995

U.S. Pat. No. 5,444,516

Patentee: Michlin, et al.

Issue Date: Aug. 22, 1995

U.S. Pat. No. 5,170,212 discloses a self sealing journal assembly for use with a load shaft of a development apparatus including a bearing member, a sliding member that is keyed to a shaft member, and that is forced into contact with the bearing member by a plurality of deflectable cantilever spring fingers.

U.S. Pat. No. 5,444,516 discloses a sleeve for the shaft section of a plastic drum axle of a photoconductive drum. The sleeve assists in supporting the axle. The sleeve snugly fits the gear piece of the photoconductive drum, eliminating clearance between the axle and the drum.

U.S. Pat. No. 5,452,056 discloses a device to prevent the eccentricity of a rotary shaft for supporting an image bearing member. When the image bearing member is rotated, a projection is provided on the outer surface of the rotary shaft fitted into fitting hole formed in a casing for securing the rotary shaft.

U.S. Pat. No. 5,457,520 discloses a bearing for supporting a photoconductive drum. The bearing includes a U-shaped member and a second securing member for securing the U-shaped member to a support structure.

SUMMARY OF THE INVENTION

In accordance with one aspect of the present invention, there is provided a supporting apparatus for supporting a photoconductive member within the housing of a printing cartridge for use in a printing machine is provided. The supporting apparatus includes a body, a connecting feature and a supporting feature. The connecting feature is connected to the body for quick and removable connection to the housing. The supporting feature is connected to the body cooperating with the body for rotatably supporting the photoconductive member within the housing.

In accordance with another aspect of the present invention, there is provided a printing cartridge for use in a printing machine for applying developer material onto a latent image to form a developed image. The printing cartridge includes a housing defining a chamber therein for storing developer material and a photoconductive member. The photoconductive member holdings the latent image. The developer material is advanced toward the photoconductive member to form the developed image. The printing cartridge a supporting apparatus for supporting the photoconductive member within the housing of the printing cartridge. The supporting apparatus includes a body, a connecting feature connected to said body for quick and removable connection to the housing, and a supporting feature connected to said body cooperating with the body for rotatably supporting the photoconductive member within the housing.

In accordance with yet another aspect of the present invention, there is provided an electrophotographic printing machine of the type including a printing cartridge for applying developer material onto a latent image to form a developed image. The printing cartridge includes a housing defining a chamber therein for storing developer material and a photoconductive member. The photoconductive member holdings the latent image. The developer material is advanced toward the photoconductive member to form the developed image. The printing cartridge a supporting apparatus for supporting the photoconductive member within the housing of the printing cartridge. The supporting apparatus includes a body, a connecting feature connected to said body for quick and removable connection to the housing, and a supporting feature connected to said body cooperating with the body for rotatably supporting the photoconductive member within the housing.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
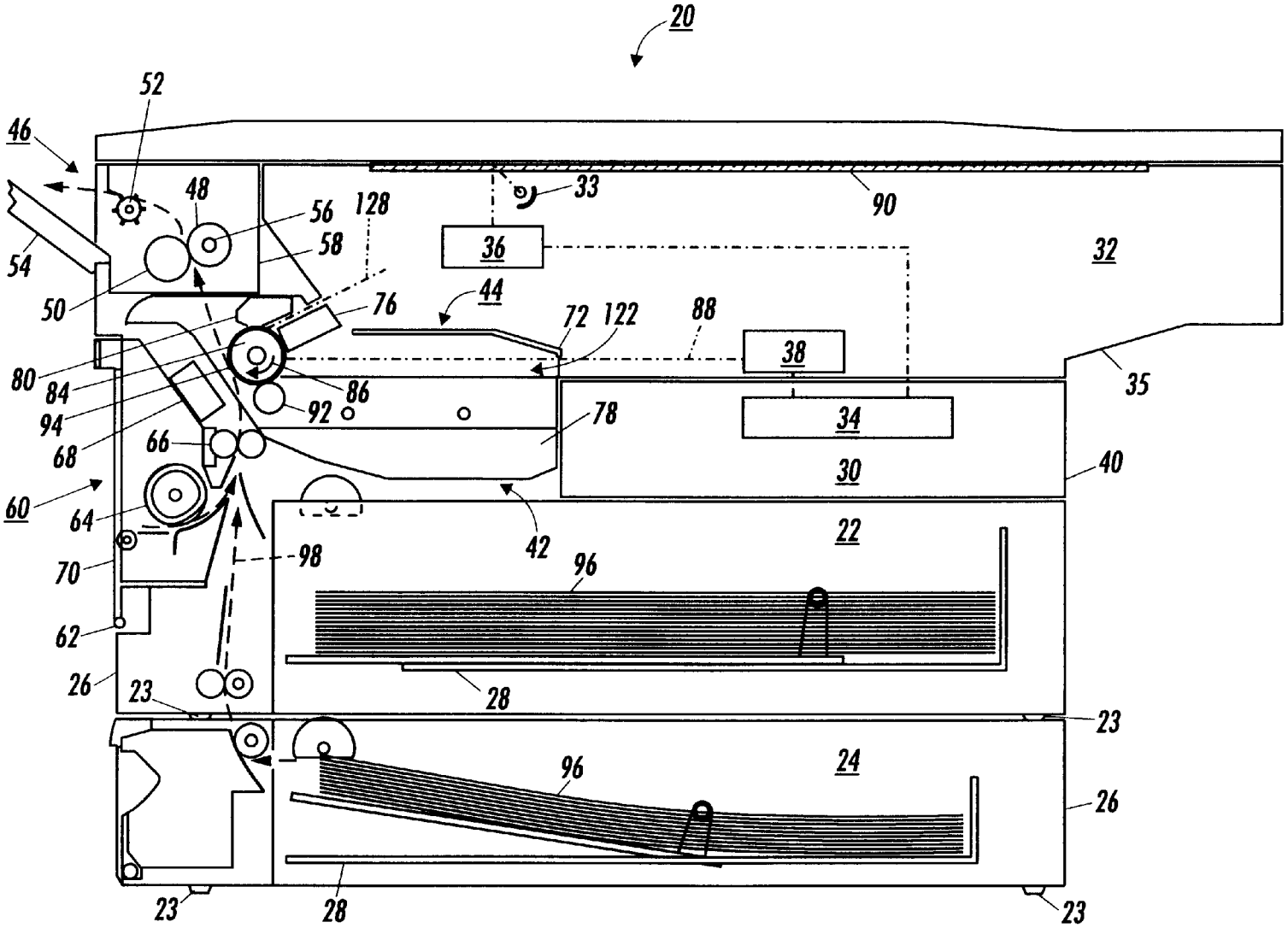
FIG. 1 is a front vertical illustration of an exemplary compact electrostatographic reproduction machine comprising separately framed mutually aligning modules in accordance with the present invention.
Figure 9:
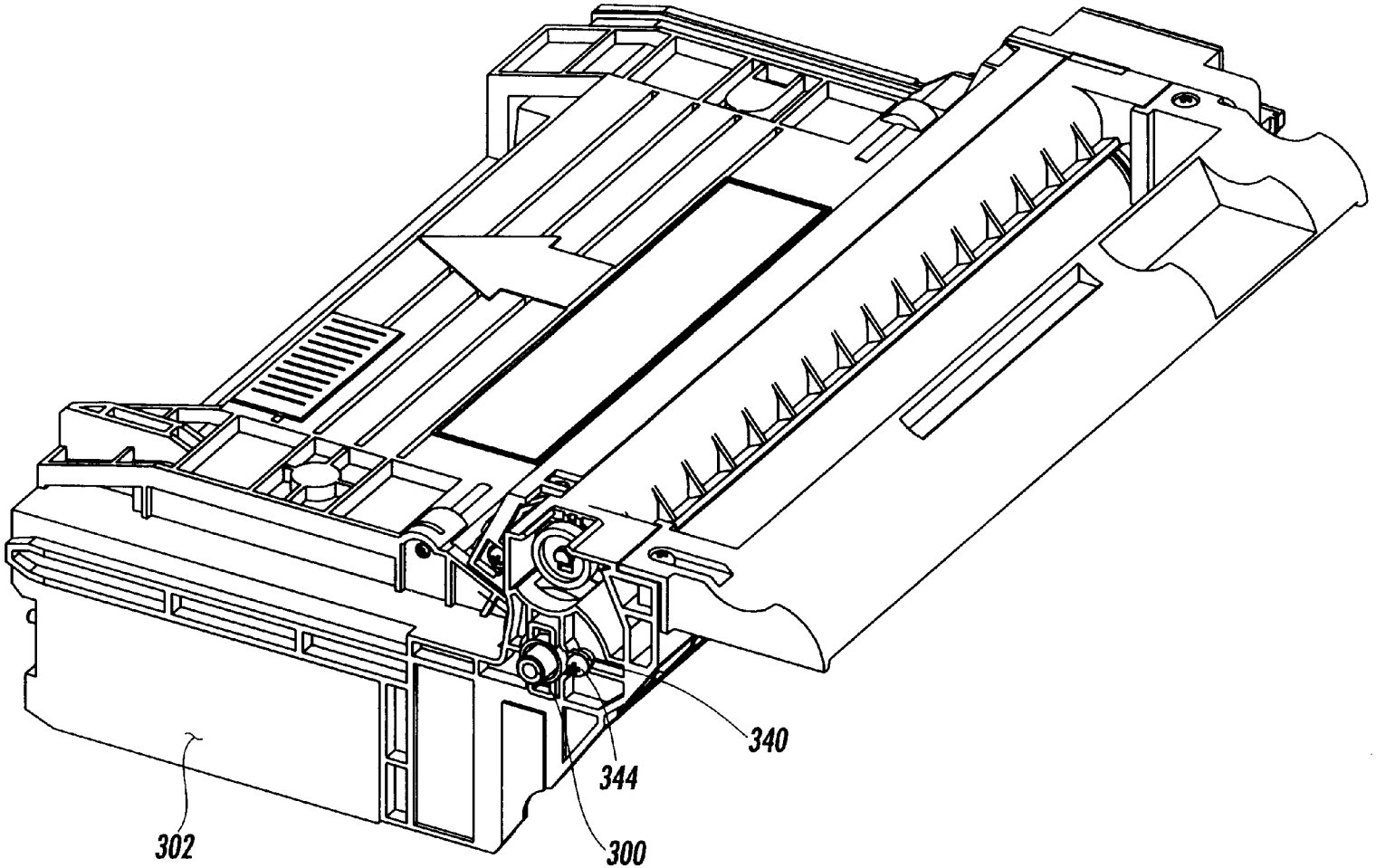
FIG. 9 is a perspective view of the CRU or process cartridge module of FIG. 2.

Referring now to FIGS. 1 and 9, there is illustrated a frameless exemplary compact electrostatographic reproduction machine 20 comprising separately framed mutually aligning modules according to the present invention. The compact machine 20 is frameless, meaning that it does not have a separate machine frame to which electrostatographic process subsystems are assembled, aligned to the frame, and then aligned relative to one another as is typically the case in conventional machines. Instead, the architecture of the compact machine 20 is comprised of a number of individually framed, and mutually aligning machine modules that variously include pre-aligned electrostatographic active process subsystems.

As shown, the frameless machine 20 comprises at least a framed copy sheet input module (CIM) 22. Preferably, the machine 20 comprises a pair of copy sheet input modules, a main or primary module the CIM 22, and an auxiliary module the (ACIM) 24, each of which has a set of legs 23 that can support the machine 20 on a surface, therefore suitably enabling each CIM 22, 24 to form a base of the machine 20. As also shown, each copy sheet input module (CIM, ACIM) includes a module frame 26 and a copy sheet stacking and lifting cassette tray assembly 28 that is slidably movable in and out relative to the module frame 26. When as preferred here, the machine 20 includes two copy sheet input modules, the very base module is considered the auxiliary module (the ACIM), and the top module which mounts and mutually aligns against the base module is considered the primary module (the CIM).

The machine 20 next comprises a framed electronic control and power supply (ECS/PS) module 30, that as shown mounts onto, and is mutually aligned against the CIM 22 (which preferably is the top or only copy sheet input module). A framed latent image forming imager module 32 then mounts over and is mutually aligned against the ECS/PS module. The ECS/PS module 30 includes all controls and power supplies (not shown) for all the modules and processes of the machine 20. It also includes an image processing pipeline unit (IPP) 34 for managing and processing raw digitized images from a Raster Input Scanner (RIS) 36, and generating processed digitized images for a Raster Output Scanner (ROS) 38. The ECS/PS module 30 also includes harnessless interconnect boards and inter-module connectors (not shown), that provide all power and logic paths to the rest of the machine modules. An interconnect board (PWB) (not shown) connects the ECS controller and power supply boards (not shown) to the inter-module connectors., as well as locates all of the connectors to the other modules in such a manner that their mating connectors would automatically plug into the ECS/PS module during the final assembly of the machine 20. Importantly, the ECS/PS module 30 includes a module frame 40 to which the active components of the module as above are mounted, and which forms a covered portion of the machine 20, as well as locates, mutually aligns, and mounts to adjacent framed modules, such as the CIM 22 and the imager module 32.

The framed copy sheet input modules 22, 24, the ECS/PS module 30, and the imager module 32, as mounted above, define a cavity 42. The machine 20 importantly includes a customer replaceable, all-in-one CRU or process cartridge module 44 that is insertably and removably mounted within the cavity 42, and in which it is mutually aligned with, and operatively connected to, the framed CIM, ECS/PS and imager modules 22, 30, 32.

As further shown, the machine 20 includes a framed fuser module 46, that is mounted above the process cartridge module 44, as well as adjacent an end of the imager module 32. The fuser module 46 comprises a pair of fuser rolls 48, 50, and at least an exit roll 52 for moving an image carrying sheet through, and out of, the fuser module 46 into an output or exit tray 54. The fuser module also includes a heater lamp 56, temperature sensing means (not shown), paper path handling baffles (not shown), and a module frame 58 to which the active components of the module, as above, are mounted, and which forms a covered portion of the machine 20, as well as locates, mutually aligns, and mounts to adjacent framed modules, such as the imager module 32 and the process cartridge module 44.

The machine then includes an active component framed door module 60 that is mounted pivotably at pivot point 62 to an end of the CIM 22. The door module 60 as mounted, is pivotable from a substantially closed vertical position into an open near-horizontal position in order to provide access to the process cartridge module 44, as well as for jam clearance of jammed sheets being fed from the CIM 22. The Door module 60 comprises active components including a bypass feeder assembly 64, sheet registration rolls 66, toner image transfer and detack devices 68, and the fused image output or exit tray 54. The door module 60 also includes drive coupling components and electrical connectors (not shown), and importantly, a module frame 70 to which the active components of the module as above are mounted, and which forms a covered portion of the machine 20, as well as, locates, mutually aligns, and mounts to adjacent framed modules, such as the CIM 22, the process cartridge module 44, and the fuser module 46.

More specifically, the machine 20 is a desktop digital copier, and each of the modules 22, 24, 30, 32, 44, 48, 60, is a high level assembly comprising a self-containing frame and active electrostatographic process components specified for sourcing, and enabled as a complete and shippable product. It is believed that some existing digital and light lens reproduction machines may contain selective electrostatographic modules that are partitioned for mounting to a machine frame, and in such a manner that they could be designed and manufactured by a supplier. However, there are no known such machines that have no separate machine frame but are comprised of framed modules that are each designed and supplied as self-standing, specable (i.e. separately specified with interface inputs and outputs), testable, and shippable module units, and that are specifically crafted and partitioned for enabling all of the critical electrostatographic functions upon a simple assembly. A unique advantage of the machine 20 of the present invention as such is that its self-standing, specable, testable, and shippable module units specifically allow for high level sourcing to a small set of module-specific skilled production suppliers. Such high level sourcing greatly optimizes the quality, the total cost, and the time of delivering of the final product, the machine 20.

Referring now to FIGS. 1–6, the CRU or process cartridge module 44 generally comprises a module housing subassembly 72, a photoreceptor subassembly 74, a charging subassembly 76, a developer subassembly 78 including a source of fresh developer material, a cleaning subassembly 80 for removing residual toner as waste toner from a surface of the photoreceptor, and a waste toner sump subassembly 82 for storing waste toner. The module housing subassembly 72 of the CRU or process cartridge module 44 importantly provides and includes supporting, locating and aligning structures, as well as driving components for the process cartridge module 44.

Still referring to FIG. 1, operation of an imaging cycle of the machine 20 using the all-in-one process cartridge module 44 generally, can be briefly described as follows. Initially, a photoreceptor in the form of a photoconductive drum 84 of the customer replaceable unit (CRU) or process cartridge module 44, rotating in the direction of the arrow 86, is charged by the charging subassembly 76. The charged portion of the drum is then transported to an imaging/exposing light 88 from the ROS 38 which forms a latent image on the drum 84, corresponding to an image of a document positioned on a platen 90, via the imager module 32. It will also be understood that the imager module 32 can easily be changed from a digital scanning module to a light lens imaging module.

The portion of the drum 84 bearing a latent image is then rotated to the developer subassembly 78 where the latent image is developed with developer material such as with charged single component magnetic toner using a magnetic developer roller 92 of the process cartridge module 44. The developed image on the drum 84 is then rotated to a near vertical transfer point 94 where the toner image is transferred to a copy sheet substrate 96 fed from the CIM 22 or ACIM 22 along a copy sheet or substrate path 98. In this case, the detack device 68 of the door module 60 is provided for charging the back of the copy sheet substrate (not shown) at the transfer point 94, in order to attract the charged toner image from the photoconductive drum 84 onto the copy sheet substrate.

The copy sheet substrate with the transferred toner image thereon, is then directed to the fuser module 46, where the heated fuser roll 48 and pressure roll 50 rotatably cooperate to heat, fuse and fix the toner image onto the copy sheet substrate. The copy sheet substrate then, as is well known, may be selectively transported to the output tray 54 or to another post-fusing operation.

The portion of the drum 84 from which the developed toner image was transferred is then advanced to the cleaning subassembly 80 where residual toner and residual charge on the drum 84 are removed therefrom. The imaging cycle of the machine 20 using the drum 84 can then be repeated for forming and transferring another toner image as the cleaned portion again comes under the charging subassembly 76.

The detailed and specific advantageous aspects of the structure and operation of the all-in-one CRU or process cartridge module 44, will now be described with particular reference to FIGS. 1 to 6. As shown, the all-in-one CRU or process cartridge module 44, generally includes six subassemblies comprising the module housing subassembly 72 (FIG. 2); the cleaning subassembly 80; the photoreceptor subassembly 74; the charging subassembly 76; the developer subassembly 78 (FIG. 3); and the waste toner sump subassembly 82. Generally, the function of the all-in-one CRU or process cartridge module 44 in the machine 20 is to electrostatically form a latent image, develop such latent image into a toner image through toner development, and transfer the toner image unfused onto a printing medium, such as a sheet of paper. The CRU or process cartridge module is left-side accessible to an operator facing the CIM 22 by opening the door module 60 (FIG. 1). Once the door module is opened, an operator or customer can remove or insert the CRU or process cartridge module 44 with one hand.

Figure 2:
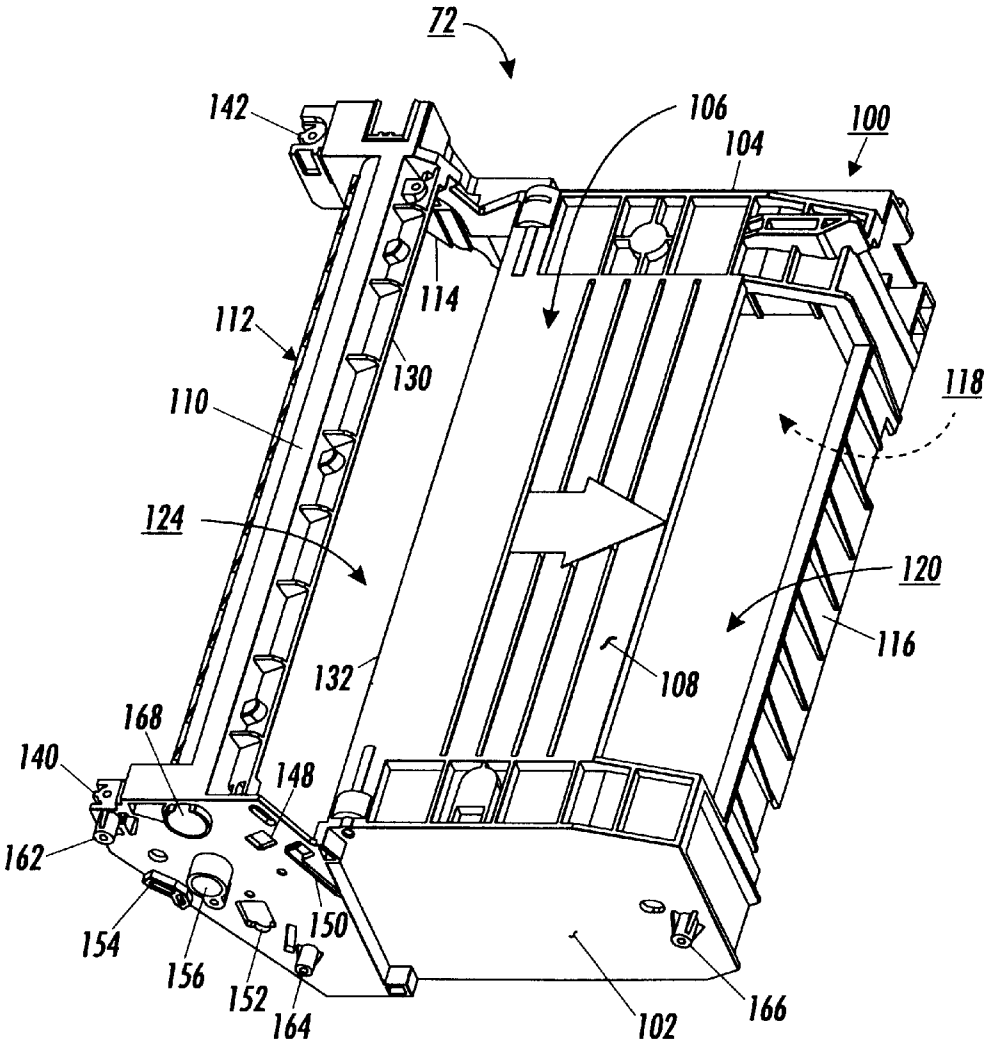
FIG. 2 is a top perspective view of the module housing of the CRU or process cartridge module of the machine of FIG. 1.
Figure 3:
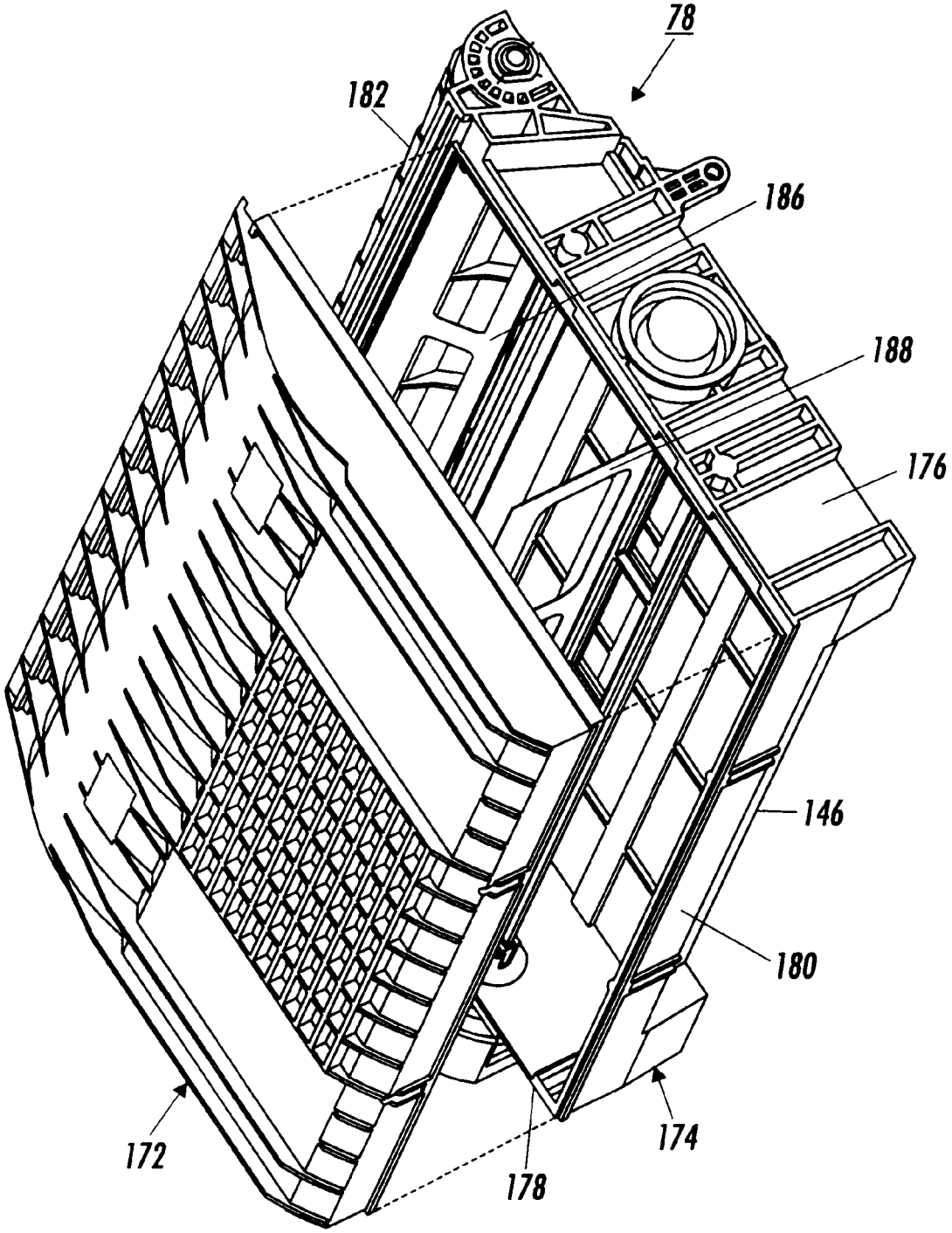
FIG. 3 is a bottom perspective view of the developer subassembly of the CRU or process cartridge module of the machine of FIG. 1 with the bottom of the developer housing unattached.

Referring now to FIGS. 1–6, the module housing subassembly 72 is illustrated (FIG. 2). As shown, it comprises a generally rectangular and inverted trough shaped module housing 100 having a first side wall 102, a second and opposite side wall 104, a top wall 106 including a substantially horizontal portion 108 and a nearly vertical portion 110 defining a raised rear end 112 (rear as considered relative to the process cartridge 44 being inserted into the cavity 42). There is no rear wall, thus resulting in an open rear end 114 for mounting the photoreceptor subassembly 74. The trough shaped module housing also includes a front end wall 116 that connects at an angle to the top wall 106. The trough shaped module housing 100 of course, has no bottom wall, and hence as inverted, it defines a trough region 118 that is wide open for assembling the developer subassembly 78 (FIG. 3). The top wall 106 and the front end wall 116 each include a first cutout 120 formed through their adjoining corner for partially defining a first light path 122 (FIG. 1) for the exposure light 88 from the ROS 38 of the imager module 32. The top wall 106 also includes a second cutout 124 formed thereinto at the adjoining angle between the horizontal 108 and near vertical 110 portions thereof for mounting the charging subassembly 76 (FIG. 5), and for partially defining a second light path 126 (FIGS. 1 and 6) for an erase light 128 being focused into the photoreceptor area at the raised rear end 112 of the module housing 100.

Importantly, the module housing 100 includes two top wall cross-sectional surfaces 130, 132 defining the second cutout 124, and one 130, of these cross-sectional wall surfaces, has a desired angle 134 (relative to the photoreceptor surface) for mounting and setting a cleaning blade 138 (FIG. 6) of the cleaning subassembly 80. Attachment members 140, 142 are provided at the raised rear end 112 and extending from the first and second side walls 102, 104 respectively, for attaching a module handle 144 to the module housing 100.

As pointed out above, the module housing 100 is the main structure of the all-in-one CRU or process cartridge module 44, and importantly supports all other subassemblies (cleaning subassembly 80, charging subassembly 76, developer subassembly 78, and sump subassembly 82) of the all-in-one process cartridge module 44. As such, it is designed for withstanding stresses due to various dynamic forces of the subassemblies, for example, for providing a required re-action force to the developer subassembly 78. Because it is located just about 3 mm below the fuser module 46, it is therefore made of a plastic material suitable for withstanding relatively high heat generated from the fuser module. Mounts (not shown) to the developer subassembly within the trough portion of the module housing subassembly are located such that the top wall 106 of the module housing defines a desired spacing comprising the first light path 122 between it and the top 146 of the developer subassembly. Similarly, the raised rear end 112 of the top wall 106 of the module housing is also such as to define a desired spacing between the charging subassembly 76 and the photoreceptor or drum 84, when both are mounted to the raised rear end 112 of the module housing 100. Additionally, the module housing 100 provides rigidity and support to the entire process cartridge module 44, and upon assembly mutually self-aligns the CRU or process cartridge module 44 relative to abutting modules such as the CIM 22, and ECS/PS module 30.

Figure 5:
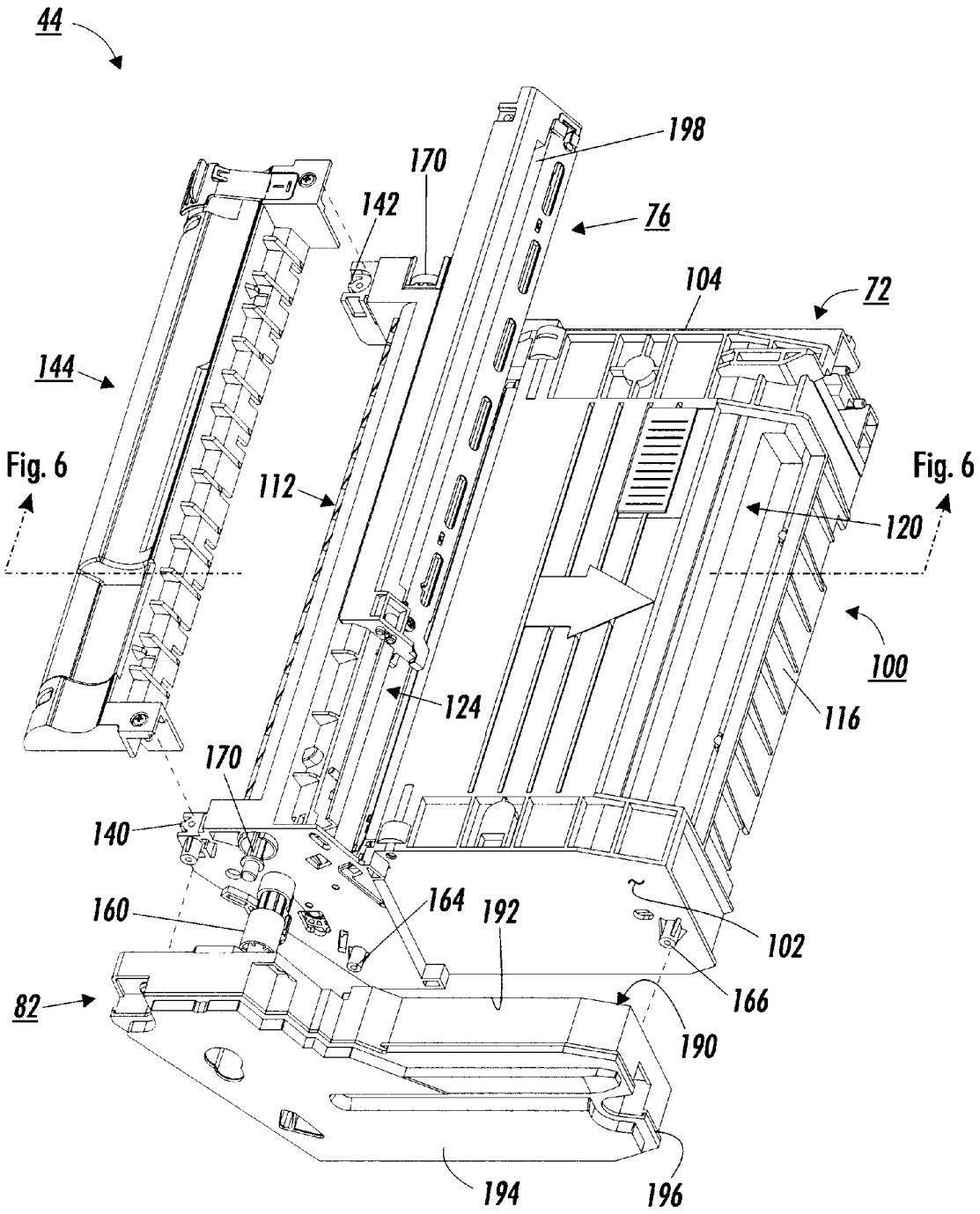
FIG. 5 is an exploded view of the various subassemblies of the CRU or process cartridge module of the machine of FIG. 1.

Referring in particular to FIG. 2, the first side wall 102 includes electrical connectors 148, 150 for supplying power from the ECS/PS module 30 (FIG. 1) via the sump subassembly 82 to the charging subassembly 76. It also includes an electrical connector 152 for supplying an electrical bias to the developer subassembly 78, as well as an alignment member 154 for aligning the detack device 68 (FIG. 1) to the photoreceptor. As also shown, the first side wall 102 further includes an apertured retainer device 156 for receiving an electrical grounding pin 160 for the photoreceptor 84. Importantly, the first side wall 102 further includes mounting members 162, 164, 166 for mounting the sump subassembly 82 to the module housing 100, and an opening for mounting an auger 170 of the cleaning subassembly 80 (FIGS. 1 and 5). The opening 168 also passes waste toner received from the photoreceptor 84 in the raised rear end 112, into the sump assembly 82, when mounted as above.

Referring now to FIG. 3, the developer subassembly 78 of the process cartridge module 44 is illustrated with an expandable bottom member 172 unattached in order to reveal the inside of the developer subassembly. As shown, the developer subassembly 78 comprises a generally rectangular developer housing 174 having the bottom member 172, the top 146, a first side 176, a second and opposite side 178, a front end 180 (relative to cartridge insertion), and a rear end 182. The developer housing 174 is for containing developer material, such as, single component magnetic toner (not shown), and it additionally houses the magnetic developer roll 92 (FIG. 1), a development bias application device 184, and a pair of developer material or toner agitators 186, 188.

Figure 4:
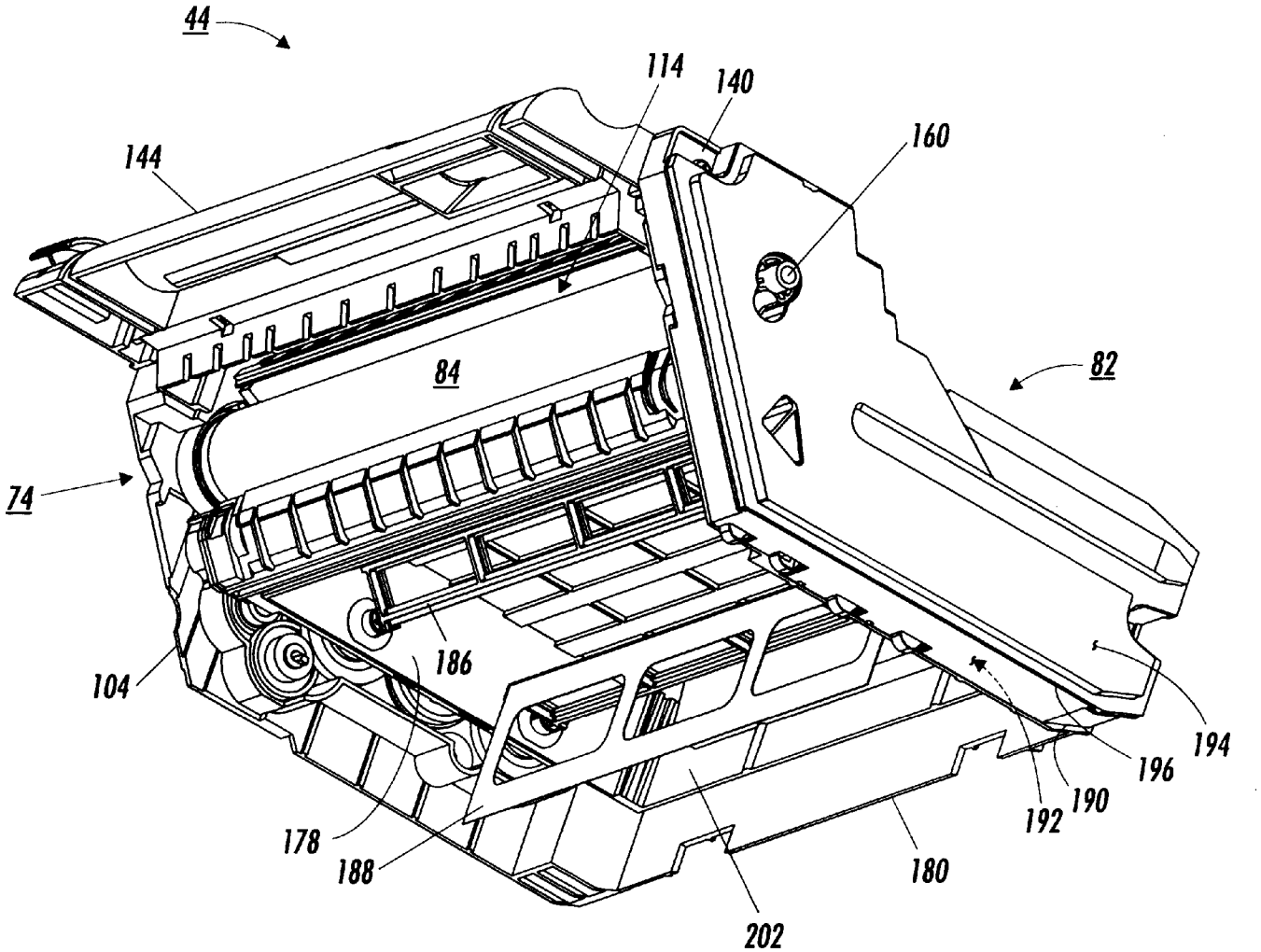
FIG. 4 is an open bottom perspective view of the CRU or process cartridge module of the machine of FIG. 1.

As shown in FIG. 4, the developer subassembly 78 is mounted to the module housing 100, and inside the trough region 118. With the bottom member 172 of the developer housing removed (for illustration purposes only), the agitators 186, 188 can clearly be seen. Also shown in FIG. 4 are the photoreceptor or drum 84 mounted within the raised rear end 112 of the module housing 100, as well as, the module handle 144 attached to the side walls 102, 104 at the raised rear end 112. The whole sump subassembly 82 is further shown with an outside surface 190 of its inside wall 192, mounted to the first side wall 102 of the module housing 100. The outside surface 194 of the outside wall 196 of the sump assembly is also clearly visible. The inside wall 192 and outside wall 196 partially define the sump cavity (not shown) for containing received waste toner, as above.

Referring now to FIG. 5, there is presented an exploded perspective view of the various subassemblies, as above, of the CRU or process cartridge module 44. As shown, the module handle 144 is attachable to mounting members 140, 142 at the raised rear end 112 of the module housing 100, and the sump subassembly 82 is mountable to the first side wall 102 of the cartridge housing. The developer subassembly 78 is mounted within the trough region 118 of the module housing 100, and is partially visible through the first cutout 120. Advantageously, the developer subassembly fits into the trough region 118 such that the top 146 (FIG. 3) of the developer subassembly and the inside of the top wall 106 of the module housing define the first light path 122 for the exposure light 88 from the ROS 38 (FIG. 1). As also shown, the charging subassembly 76 is mountable, at the second cutout 124, to the module housing 100, and includes a slit 198, through the charging subassembly, that defines part of the second light path 126 for the erase light 128 to pass to the photoreceptor 84.

Figure 6:
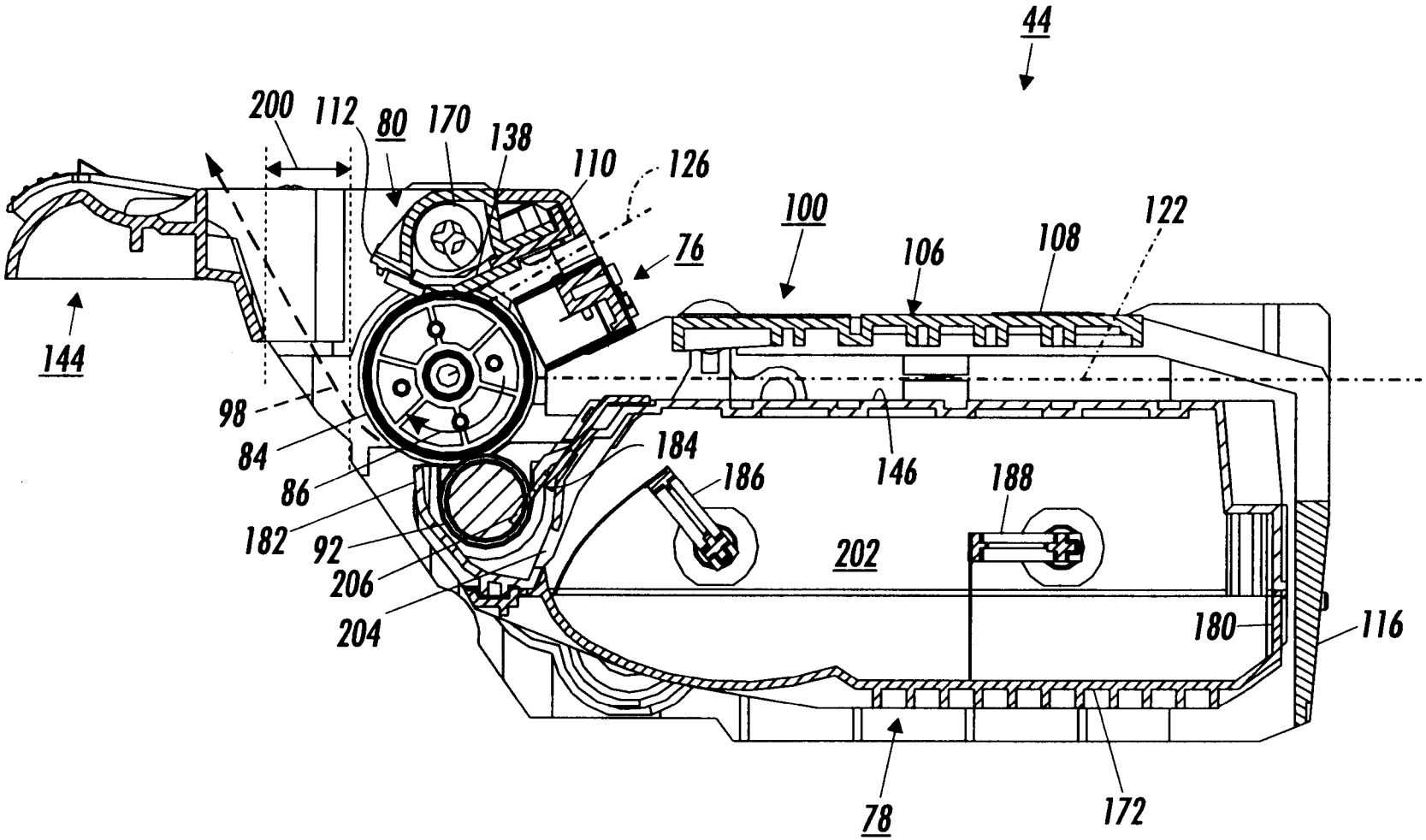
FIG. 6 is a vertical section (front-to-back) of the CRU or process cartridge module of the machine of FIG. 1.

Referring next to FIG. 6, a vertical (rear-to-back) section of the CRU or process cartridge module 44 as viewed along the plane 6—6 of FIG. 5 is illustrated. As shown, the developer subassembly 78 is mounted within the trough region 118 of the module housing subassembly 72 as defined in part by the front end wall 116, the second side wall 104, and the top wall 106 of the module housing subassembly. The module handle 144 as attached to mounting members 140, 142, (only one of which is visible), forms a portion of the sheet or paper path 98 of the machine 20 (FIG. 1) by being spaced a distance 200 from photoreceptor 84 in the raised rear end 112 of the module housing 100. The photoreceptor or drum 84 is mounted to the side walls 102, 104, (only one of which is visible), and as shown is located within the raised rear end 112 and is rotatable in the direction of the arrow 86. The charging subassembly 76 is mounted within the second cutout 124 in the top wall 106 and includes the slit 198 defining part of the second light path 126 for erase light 128 to pass to the photoreceptor 84. Upstream of the charging subassembly 76, the cleaning subassembly 80, including the cleaning blade 138 and the waste toner removing auger 170, is mounted within the raised rear end 112, and into cleaning contact with the photoreceptor 84. As further shown, the top wall 106 of the module housing 100 is spaced from the top 146 of the developer subassembly 78, thus defining the part of first light path 122 for the exposure light 88 from the ROS 38 (FIG. 1). The first light path 122 is located so as to be incident onto the photoreceptor at a point downstream of the charging subassembly 76.

The front 180, top 146, and bottom member 172 of the developer subassembly define a chamber 202, having an opening 204, for containing developer material (not shown). The first and second agitators 186, 188 are shown within the chamber 202 for mixing and moving developer material towards the opening 204. The developer material biasing device 184 and a charge trim and metering blade 206 are mounted at the opening 204. As also shown, the magnetic developer roll 92 is mounted at the opening 204 for receiving charged and metered developer material from such opening, and for transporting such developer material into a development relationship with the photoreceptor 84.

According to the present invention, and referring now to FIG. 9, a photoconductor support shaft 300 is shown mounted on to CRU module housing 302.

Figure 7:
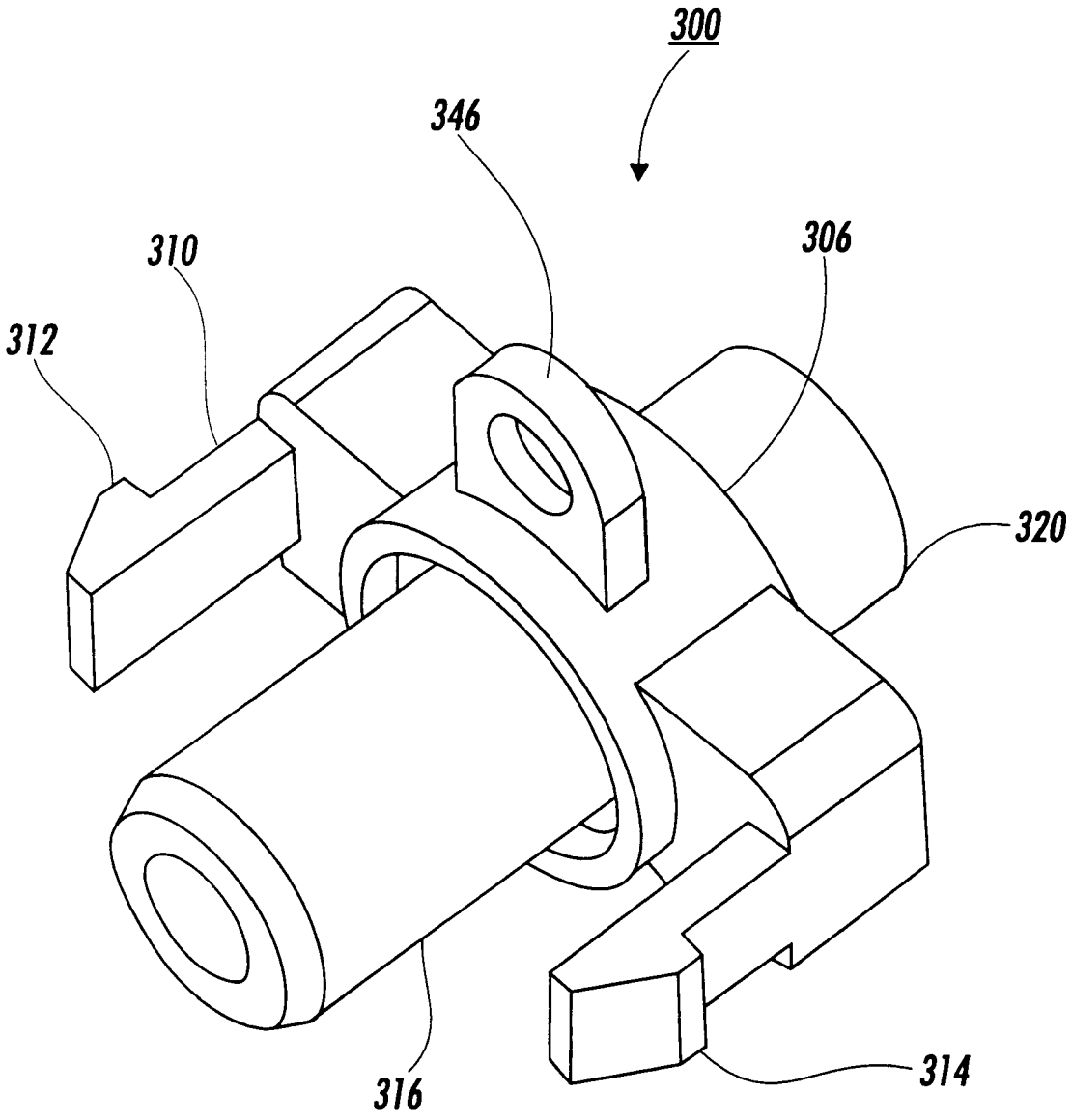
FIG. 7 is a perspective view of a quick change photoreceptor support according to the present invention.

Referring now to FIG. 7, the photoconductive drum support shaft 300 is shown in greater detail. The supporting shaft 300 includes a body 306. Extending outwardly from the body 306 is a connection feature 310. The connection feature 310 serves to connect the body 306 to the housing 302 (see FIG. 9).

Referring again to FIG. 7, the connection feature 310 may be in the form of spaced apart symmetrical first and second connecting features 312 and 314. The body 306 further includes a photoconductor supporting feature 316 which extends outwardly from body 306 of the photoconductor drum support shaft 300. The photoconductor drum supporting feature 316 serves to support the photoconductor drum as it rotates in position.

Preferably, the body 306 further includes an imaging engaging feature 320 for engaging with the imaging apparatus to position the photoconductive drum with respect to the imager.

Figure 8:
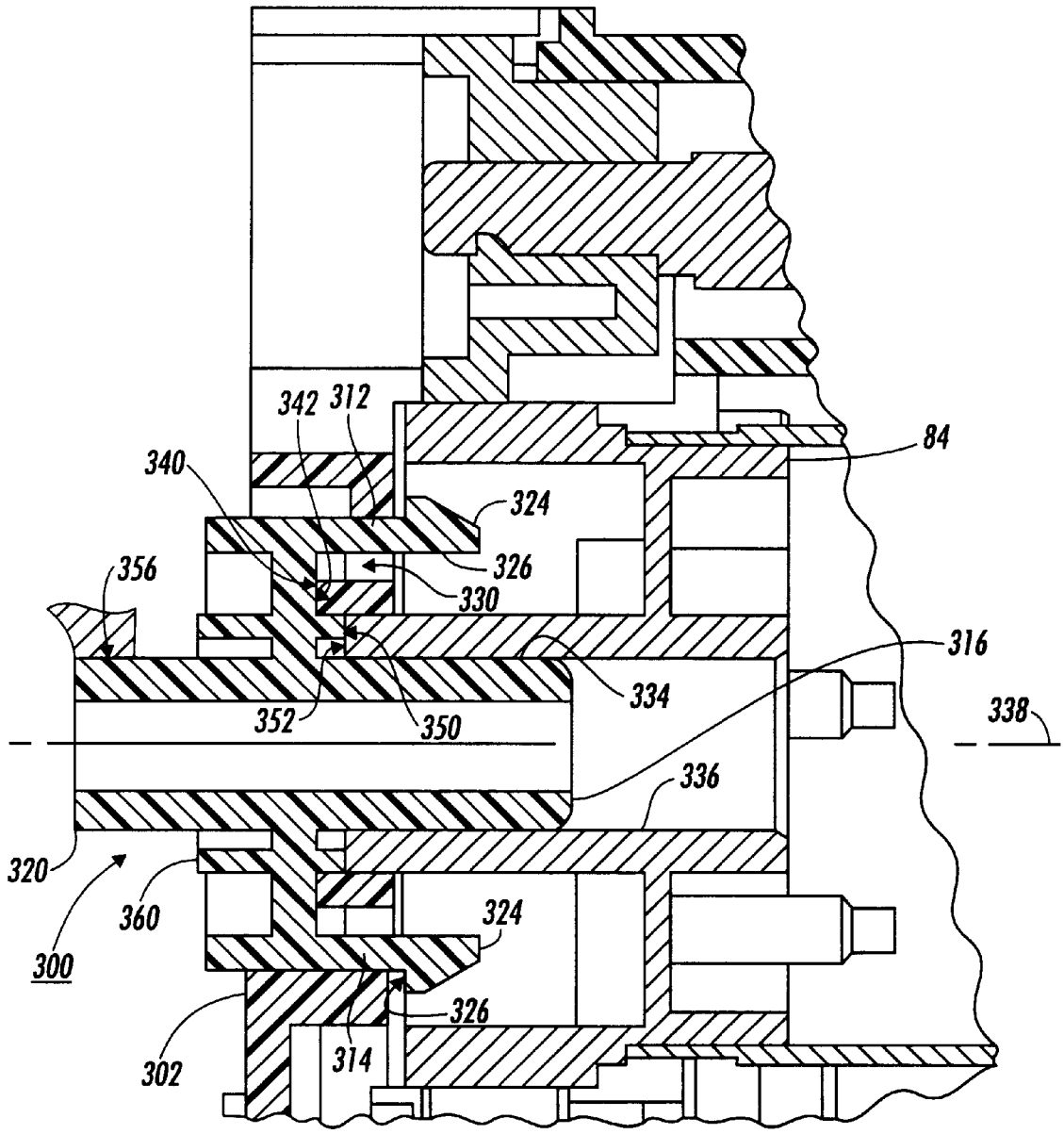
FIG. 8 is a cross sectional view of FIG. 9 along the line 8-8 in the direction of the arrows.

Referring now to FIG. 8, the support shaft 300 is shown in position supporting a photoconductive drum 84 within the housing 302. The support shaft 300 may be made of any suitable durable material. For example, the support shaft 300 may be made of a plastic. For example, acetone or polycarbonate.

The support shaft 300 may be secured to housing 302 in any suitable fashion. Preferably the support shaft 300 is removably secured to the housing 302. For example, as shown in FIG. 8, the support shaft 300 includes first and second connection features 312 and 314 in the form of arms extending from body 306 of the support shaft 300.

Preferably, to interconnect the support shaft 300 to the photoconductive drum 84, the first and second arms 312 and 314 include protrusions or lips 324 which extend from distal ends 326 of the first and second arms 312 and 314. Slots 330 are formed in housing 302.

Preferably, the arms 312 and 314 are pliable such that the arms 312 and 314 bend inwardly as they are inserted through the slots 330 of the housing 302. The lips 324 of the arms 312 and 314 engage securely the arms 312 and 314 to the housing 302 to secure the shaft 300 to the housing 302.

The PR supporting features 316 may have any suitable shape but preferably as shown in FIG. 8 is in the form of a hollow cylinder having an outer periphery of 334 which is mating fitted with bore 336 of the photoconductive drum 84. The drum 84 rotates about support shaft 300 along axis 338. Mounting face 340 of the support shaft 300 is secured to mounting face 342 of the housing 302.

Referring again to FIG. 9, to further secure the support shaft 300 to the housing 302, a fastener in the form of for example a screw 344 is secured to housing 302 by threads and by loop 346 to shaft 300.

Referring again to FIG. 8, to provide axial position for the photoconductor drum 84 preferably, the support shaft 300 includes a drum support surface 350 which mates with drum support face 352. The small and controlled contact between the faces 350 and 352 provide for smooth and uniform thrust forces between the photoconductive drum 84 and the housing 302, thus providing for smooth rotation of the photoconductive drum 84 and resulting improved image quality.

Preferably, the support shaft 300 further includes an image engagement feature 320 which extends outwardly from the housing 302 and aligning and engaging photoreceptor drum 84 to imager (not shown). The supporting feature 320 may have any suitable shape but preferably is in the form of a hollow cylinder having an outer periphery 356 which mates with a feature on the imager to locate the imager with respect to the photoconductive drum 84. The outer periphery 356 of the imaging feature 320 serves to provide vertical and horizontal positioning of the photoconductive drum 84 with respect to the imager.

To provide positioning of the photoconductive drum along the axis 338, preferably, the support shaft 300 further includes a axial positioning feature 360 in the form of imaging feature location face 360. Face 360 extends outwardly from the housing 302 and contacts the imaging device to provide axial location of the photoconductor drum 84 therewith. The small circular contact surface of the face 360 provides for smooth and accurate axial support of the imaging feature with respect to the photoconductor drum 84 thus maintaining improved image quality.

Figure 10:
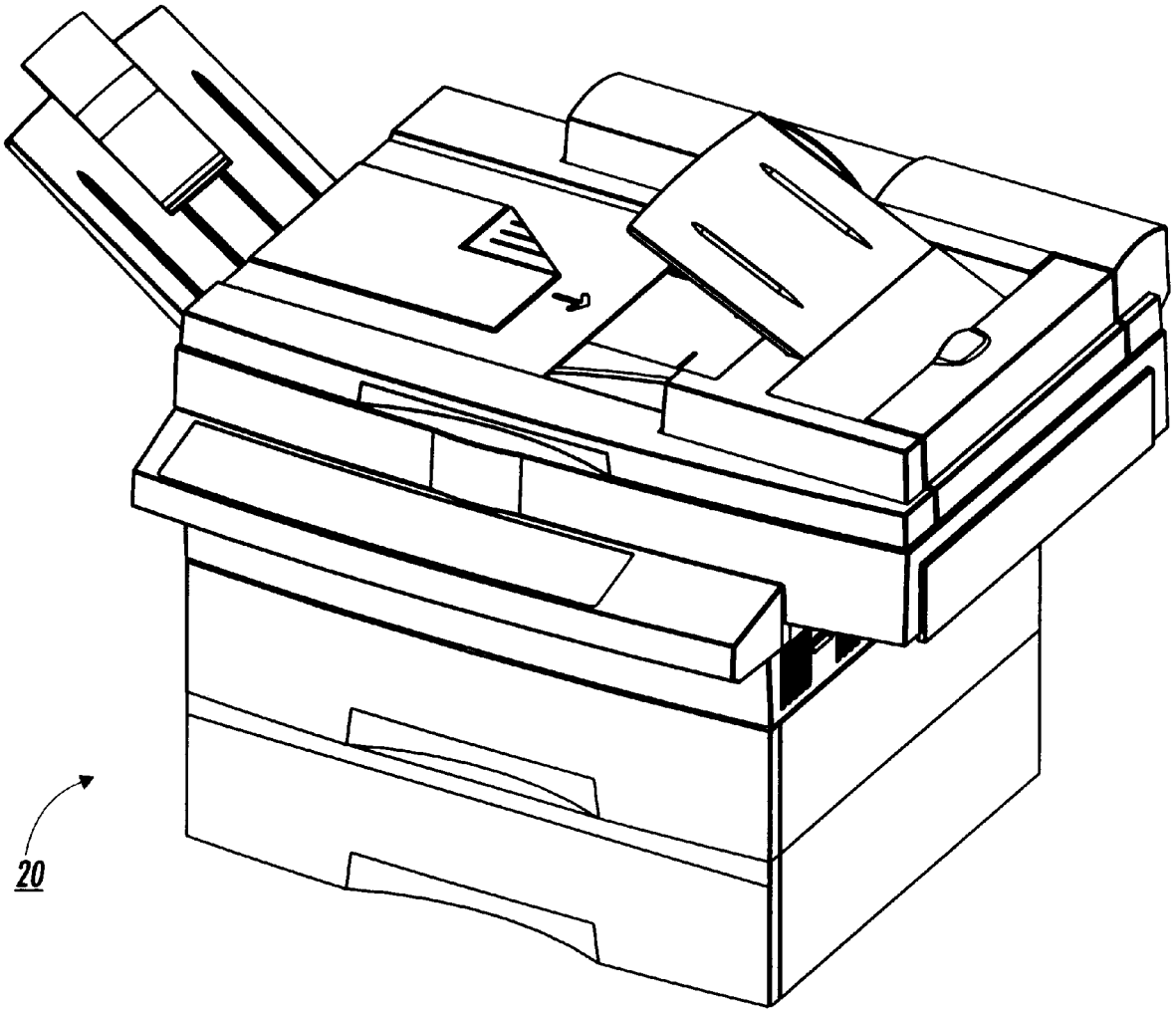
FIG. 10 is a perspective view of the machine of FIG. 1.

Referring now to FIG. 10, a printing machine is shown utilizing the photoconductor support shaft of the present invention.

By providing a photoconductive support shaft with a snap in feature the assembly for assembling the photoconductor to the cartridge may be minimized.

By providing a photoconductive support shaft with a thrust face for the photoconductor, smooth, accurate rotation of the photoconductor may be accomplished.

By providing a photoconductor support shaft with an integral scanner alignment feature, accurate scanning can be accomplished.

By providing a photoconductive drum support shaft with a axial scanning support thrust face, improved scanning accuracy can be accomplished.

By providing a photoconductor support shaft with integral scanning features in all three axis improved, high-precision alignment to the ROS may be accomplished.

By providing a photoconductor support shaft with a separate accurate thrust surface, improved dampening of the photoconductor may be accomplished.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A supporting apparatus for supporting a photoconductive member within the housing of a printing cartridge for use in a printing machine, said supporting apparatus comprising:

a body member having at least a length and width;

at least one connecting member integrally connected to and extending from said body, the at least one connecting member adapted for removable connection to a housing; and a supporting member spaced from the at least one connecting member, the supporting member having a length and longitudinal axis and being connected to said body for rotatable support of a photoconductive member within the housing wherein the at least one connecting member extends along at least part of the supporting member.

2. A supporting apparatus according to claim 1, wherein the photoconductive member comprises a photoconductive drum.

3. A supporting apparatus according to claim 2, wherein said connecting member comprises at least one protrusion extending from said body, said protrusion including a lip on the distal end thereof, said protrusion and said lip adapted to cooperate with the housing for removable connection to the housing.

4. A supporting apparatus according to claim 2, wherein said supporting member comprises a cylinder, the outer periphery of said cylinder rotatably cooperable with said photoconductive member.

5. A supporting apparatus according to claim 1, further comprising a thrust bearing member connected to said body.

6. A supporting apparatus according to claim 5, wherein said thrust bearing member comprises a circular ring concentric to said body.

7. A supporting apparatus according to claim 1, wherein said body comprises a plastic.

8. A supporting apparatus according to claim 1, wherein the at least one connecting member and said supporting member are integral with said body.

9. A supporting apparatus according to claim 1, further comprising an alignment member connected to said body for aligning the photoconductive member to an imaging module.

10. A supporting apparatus according to claim 9, wherein said alignment member comprises a cylinder, the outer periphery of said cylinder rotatably cooperable with said imaging module.

11. A printing cartridge for use in a printing machine for applying developer material onto a latent image to form a developed image, said printing cartridge comprising:

a housing defining a chamber therein for storing developer material;

a photoconductive member for holding the latent image, the developer material being advanced toward said photoconductive member to form the developed image; and a supporting apparatus for supporting said photoconductive member within the housing of the printing cartridge, said supporting apparatus including a body, at least one connecting member integrally connected to and extending from said body and adapted for removable connection to the housing, and a supporting member connected to said body and cooperating with said body for rotatably supporting said photoconductive member within said housing wherein the at least one connecting member extends along at least part of the supporting member.

12. A printing cartridge according to claim 11, wherein the photoconductive member comprises a photoconductive drum.

13. A printing cartridge according to claim 12, wherein said connecting member comprises at least one protrusion extending from said body said protrusion including a lip on the distal end thereof, said protrusion and said lip cooperable with the housing for quick and removable connection to the housing.

14. A printing cartridge according to claim 12, wherein said supporting member comprises a cylinder, the outer periphery of said cylinder rotatably cooperable with said photoconductive member.

15. A printing cartridge according to claim 11, further comprising a thrust bearing member connected to said body.

16. A printing cartridge according to claim 15, wherein said thrust bearing member comprises a circular ring concentric to said body.

17. A printing cartridge according to claim 11, wherein said body comprises a plastic.

18. A printing cartridge according to claim 11, wherein the at least one connecting member and said supporting member are integral with said body.

19. A printing cartridge according to claim 11, further comprising an alignment member connected to said body for aligning the photoconductive member to an imaging module.

20. A printing cartridge according to claim 19, wherein said alignment member comprises a cylinder, the outer periphery of said cylinder rotatably cooperable with said imaging module.

21. An electrophotographic printing machine of the type including a printing cartridge for applying developer material onto a latent image to form a developed image, said printing cartridge comprising:

a housing defining a chamber therein for storing developer material;

a photoconductive member for holding the latent image, the developer material adapted to advance toward said photoconductive member to form the developed image; and a supporting apparatus for supporting said photoconductive member within the housing of the printing cartridge, said supporting apparatus including a body, a connecting member integrally connected to and extending from said body and adapted for removable connection to the housing, and a supporting member connected to said body and cooperating with said body for rotatably supporting said photoconductive member within said housing wherein the connecting member extends along at least part of the supporting member.

22. A printing machine according to claim 21, wherein the photoconductive member comprises a photoconductive drum.

23. A printing machine according to claim 22, wherein said connecting member feature comprises at least one protrusion extending from said body said protrusion including a lip on the distal end thereof, said protrusion and said lip adapted to cooperate with the housing for removable connection to the housing.

24. A printing machine according to claim 22, wherein said supporting member feature comprises a cylinder, the outer periphery of said cylinder rotatably cooperable with said photoconductive member.

25. A printing machine according to claim 21, further comprising a thrust bearing member connected to said body.

26. A printing machine according to claim 25, wherein said thrust bearing member comprises a circular ring concentric to said body.

27. A printing machine according to claim 21, wherein said body comprises a plastic.

28. A printing machine according to claim 21, wherein at least one of said connecting member and said supporting member are integral with said body.

29. A printing machine according to claim 21, further comprising an alignment member connected to said body for aligning the photoconductive member to an imaging module.

30. A printing machine according to claim 29, wherein said alignment member comprises a cylinder, the outer periphery of said cylinder rotatably cooperable with said imaging module.

* * * * *